US005659963A

United States Patent [19]

McCrady

[11] Patent Number: 5,659,963

[45] Date of Patent: Aug. 26, 1997

[54] COIN AND TOKEN ROLL OPENER

[76] Inventor: Dennis McCrady, 15 Indian Creek Rd., Holmdel, N.J. 07733

[21] Appl. No.: 697,578

[22] Filed: Aug. 27, 1996

[51] Int. Cl.[6] ..... B26B 25/00

[52] U.S. Cl. ..... 30/307; 30/1.5; 30/2

[58] Field of Search ..... 30/1.5, 2, 90.1, 30/307, 316

[56] References Cited

U.S. PATENT DOCUMENTS

| | | | |
|---|---|---|---|
| 4,382,330 | 5/1983 | Harbaugh | 30/2 X |
| 4,845,844 | 7/1989 | Allen | 30/1.5 |
| 5,123,320 | 6/1992 | Hochfeld | 30/2 X |

FOREIGN PATENT DOCUMENTS

| | | | |
|---|---|---|---|
| 283408 | 10/1913 | Germany | 30/1.5 |

*Primary Examiner*—Douglas D. Watts

[57] ABSTRACT

The Coin and Token Roll Opener facilitates the opening of machine packaged paper rolls of coins and tokens. The Coin and Token Roll Opener consists of top and bottom wings, joined by an eyelet, upon which are mounted rotating, circular cutters. The wings rotate about the eyelet to fit various coin and token roll sizes. For sturdiness that facilitates the opening process, both wings are cast in aluminum and the rotating, circular cutters are constructed from stainless steel. Paper rolls of coins and tokens are opened by gripping the Coin and Token Roll Opener in one hand and inserting the roll of coins or tokens into the opener with the other hand and rotating while squeezing the sides, or wings, of the opener firmly against the roll. The four rotating, circular cutters in the opener cut off the top of the paper roll so that the paper roll can be easily peeled away from the coins or tokens.

1 Claim, 1 Drawing Sheet

COIN AND TOKEN ROLL OPENER

BACKGROUND OF THE INVENTION

1. Field of the Invention

This invention relates generally to the field of devices that are used to open coin rolls by cutting the roll about the circumference of one end.

2. Description of the Prior Art

Coin roll opening tools known in the prior art include tools that cut the paper roll longitudinally from one end to the other and tools that cut the roll about the circumference of one end. There are both hand-held and mountable coin roll opening tools.

The Coin and Token Roll Opener described here is hand-held and therefore does not take up valuable counter-top space. It is small enough to fit in a cash register drawer where it can be conveniently picked up and used to open coin rolls or handed to another user. It is also light weight and easily manipulated making it easy to use.

The small size and light weight will allow the Coin and Token Roll Opener to be conveniently stored in a car, truck, or any type of vehicle, or attached to a key chain using a small chain through the eyelet. In this setting, it can be used to quickly open coin or token rolls where the coins or tokens are used to pay fees for toll roads, parkways, and bridges. Struggling to open coin or token rolls in a moving vehicle is very dangerous for obvious reasons.

In addition, the proposed Coin and Token Roll Opener could be used to open rolls of subway tokens.

In all of the above cases, this device could save the annoyance of breaking a fingernail during the coin or token roll opening process.

The small number of parts making up this device leads to ease in manufacturing which, in turn, leads to the advantage of low cost.

The Coin and Token Roll Opener described here looks similar to a wine bottle foil opener, which is constructed from a single piece of molded plastic, but the Coin and Token Roll Opener has several important differences to enable it to open coin and token rolls of various sizes. The wine bottle foil opener will not compress enough to open rolls of coins or tokens and the single piece of molded plastic would not be a stable enough base for the intended purpose of opening paper rolls of coins and tokens. The wings of the Coin and Token Roll Opener are attached by an eyelet, in contrast to the single piece construction of the wine bottle foil opener which does not include an eyelet, and are designed and sized so that they, the wings, can rotate about the eyelet to accommodate coin and token rolls of various sizes. To precisely cut the coin or token roll during the opening process, the device needs to be sturdy to keep it from wobbling like plastic and is therefore cast from aluminum.

SUMMARY OF THE INVENTION

The purpose of the Coin and Token Roll Opener is to facilitate the opening of machine packaged paper rolls of coins and tokens. The Coin and Token Roll Opener is easily adjustable allowing all sizes of coin and token rolls to be opened with a simple movement of the hand.

An object of the present invention is to provide a new and improved tool for opening coin and token rolls that is small and light weight enough to be stored in a cash register drawer or automobile where it can be conveniently picked up and quickly used with minimal distraction to the cashier or driver.

Another object of the present invention is to minimize the cost of the tool by minimizing parts and simplifying the manufacturing process.

BRIEF DESCRIPTION OF THE DRAWING

The drawing consists of three views.

The front view, FIG. 1, shows a top view of the four circular cutters (1) that rotate during the cutting process. It shows the top of the coin and token roll support (2) and the tops of the safety walls (4,5). Also shown are the top (7) and bottom (6) wings and the eyelet (3), which holds the wings together and allows them to rotate.

The side view.

The top view.

DESCRIPTION OF THE PREFERRED EMBODIMENTS

The purpose of the Coin and Token Roll Opener (CTRO) is to facilitate the opening of machine packaged paper rolls of coins and tokens. The CTRO can be adjusted to fit the size of the coin or token roll being opened by rotating the two wings (described below) about the eyelet. Machine packaged paper rolls of coins and tokens are opened by gripping the CTRO in one hand and inserting the paper roll of coins or tokens into the opener with the other hand and rotating while squeezing the wings of the opener causing the circular, rotating cutters (described below) to make firm contact with the roll, causing the cutters to cut off the end of the paper roll. The four rotating, circular cutters in the CTRO cut off the end of the paper roll so that the paper roll can be easily peeled away.

Figure 3:
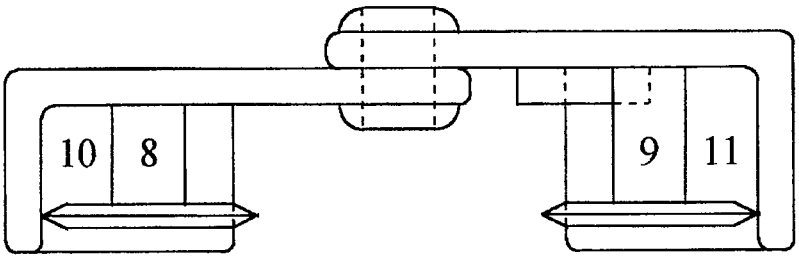
FIG. 3, shows another side view of the circular cutters. This view clearly shows the difference in height of the circular cutter supports (8,9). The top view also shows another side view of the eyelet and a partially obstructed side view of the part of the safety walls that curl around the bottom of the bottom (10) and top (11) wings.
Figure 1:
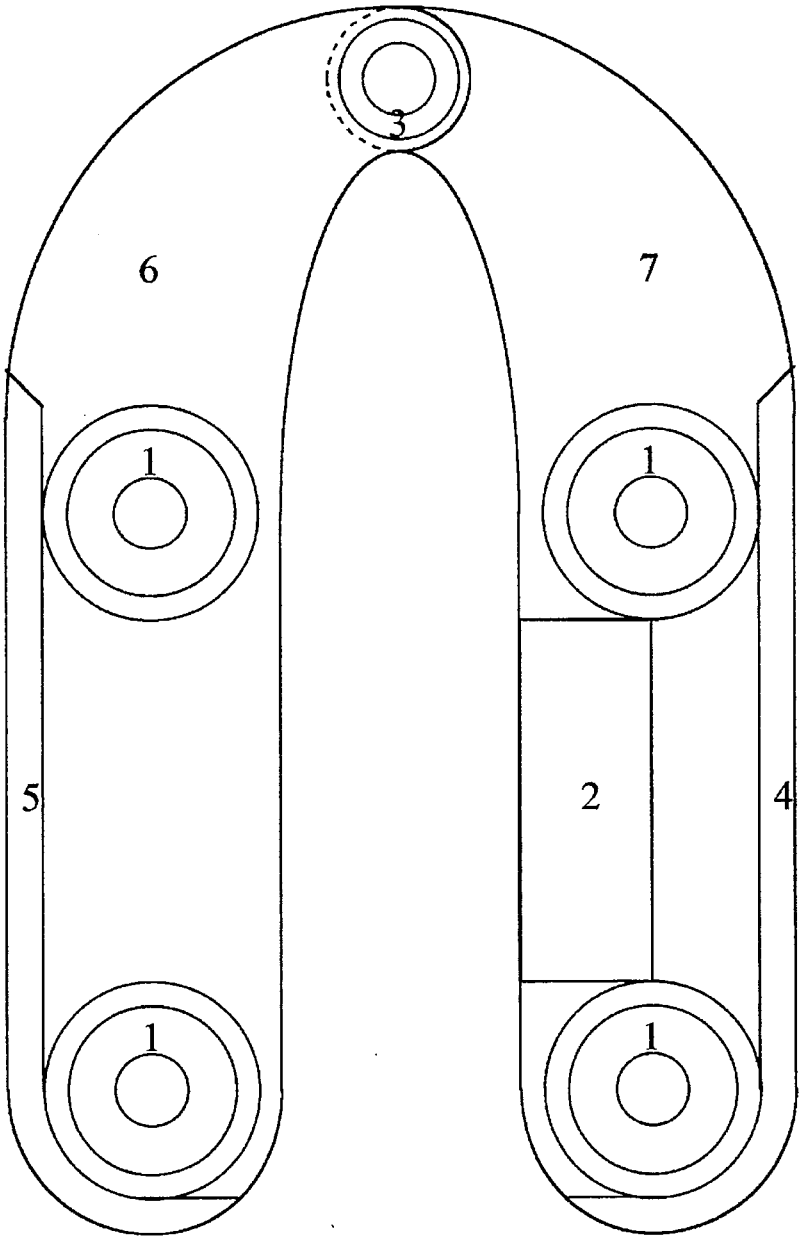
FIG. 1, the front view, FIG. 2, the side view, and FIG. 3, the top view. A scale of four inches equals one inch is used in the drawing.
Figure 2:
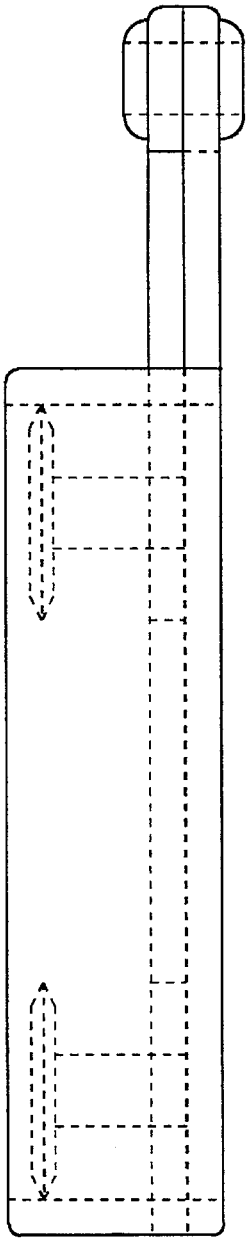
FIG. 2, shows hidden side views of the circular cutters and coin and token roll support. It shows the partially hidden side views of the two wings. It also shows a side view of the safety wall of the top wing and a side view of the eyelet.

The CTRO consists of four rotating, circular cutters (1), a coin and token roll support (2), an eyelet (3), a bottom wing (6) with a safety wall (5) and short cutter supports (8), and a top wing (7) with a safety wall (4) and long cutter supports (9) as shown in FIGS. 1, 2, and 3. The two rotating circular cutters mounted on the bottom wing are attached to the wing at the short cutter supports (8) while the two rotating, circular cutters mounted on the top wing are attached to the wing at the long cutter supports (9), as shown in FIG. 3. Different circular cutter support heights are used to compensate for the difference in height of the bottom and top wings in order to keep the cutting edges of the circular cutters on each wing at the same height.

The circular cutters (1) are constructed from stainless steel and the cutting edges are honed to the required sharpness to allow the paper roll to be cut with ease. The circular cutters rotate freely about their supports (8,9) during the cutting process and the length of the supports aligns the cutting edge of the circular cutters with the end coin or token in the roll to facilitate the cutting of the paper roll during the opening process.

The coin and token roll support (2) is part of the top wing (7) and is needed to match the height of the bottom wing (6)

in order to provide a flat, even resting place for the coin or token roll during the opening process. A flat resting place for the roll allows the four rotating, circular cutters to make a continuous cut around the paper roll for easy opening. The coin and token roll support can either be attached to the top wing after the top wing is die cast or it can be die cast as part of the top wing. In either case, the coin and token roll support is made from aluminum.

The eyelet (3) has a one-eighth (⅛) inch inside diameter and a flaring tool is used to secure the eyelet in place. The eyelet joins the top and bottom wings together while allowing them to rotate to adjust the CTRO for various sizes of coin and token rolls.

The bottom wing (6) with safety wall (5) and short cutter supports (8) is die cast from aluminum as a single piece. The contour of the bottom wing is sized so that various sizes of coin and token rolls can be opened. The bottom wing includes a circular hole through which the eyelet (3) is secured to join it with the top wing. A safety wall is included to protect the fingers of the user from the cutting edges of the circular cutters during the opening process or during casual handling of the CTRO.

The top wing (7) with safety wall (4) and long cutter supports (9) is die cast from aluminum as a single piece. The contour of the top wing is sized so that various sizes of coin and token rolls can be opened. The top wing includes a circular hole through which the eyelet (3) is secured to join it with the bottom wing. A safety wall is included to protect the fingers of the user from the cutting edges of the circular cutters during the opening process or during casual handling of the CTRO. The length of the two long cutter supports on the top wing is such that it compensates for the difference in height of the bottom and top wings in order to keep the cutting edges of the circular cutters on each wing at the same height. The coin and token roll support (2) can either be die cast in aluminum as part of the top wing or it can be made as a separate piece and then attached to the top wing.

It will be obvious to those skilled in the art that various changes may be made without departing from the intention of the present invention defined by the following claim and the invention is not to be considered limited to what is shown in the drawing and defined in the specification.

What is claimed is:

1. A coin and token roll opening device for opening a wrapped roll of coins or tokens, comprising:

a bottom wing with a safety wall and two short cutter supports;

a top wing with a safety wall and two long cutter supports coupled to said bottom wing by an eyelet;

a coin and token roll support on said top wing;

two rotating, circular cutters for contributing to cutting the wrapper of said coin or token roll each coupled to one of two said short cutter supports on said bottom wing; and two rotating, circular cutters for contributing to cutting the wrapper of said coin or token roll each coupled to one of two said long cutter supports on said top wing for cutting the wrapper of a coin or token roll when said coin or token roll is placed between said cutters with the end of said coin or token roll against said coin and token roll support when said top wing and said bottom wing are squeezed to rotate about said eyelet so that said cutters are against said coin or token roll with said cutting occurring when said coin or token roll is rotated.

* * * * *